US007442276B2

(12) United States Patent
Pillard

(10) Patent No.: US 7,442,276 B2
(45) Date of Patent: Oct. 28, 2008

(54) SEPARATOR DEVICE FOR FRANKING MACHINE FEEDER

(75) Inventor: Romain Pillard, Nemours (FR)

(73) Assignee: NEOPOST Technologies, Bagneux (FR)

( * ) Notice: Subject to any disclaimer, the term of this patent is extended or adjusted under 35 U.S.C. 154(b) by 206 days.

(21) Appl. No.: 10/762,693

(22) Filed: Jan. 22, 2004

(65) Prior Publication Data

US 2004/0206677 A1 Oct. 21, 2004

(30) Foreign Application Priority Data

Jan. 23, 2003 (FR) ..... 03 00705

(51) Int. Cl.
*B65B 43/39* (2006.01)
*B43M 7/00* (2006.01)

(52) U.S. Cl. ..... 156/441.5; 53/381.7

(58) Field of Classification Search ..... 156/441.5, 156/441.8; 53/381.1, 381.5, 381.7
See application file for complete search history.

(56) References Cited

U.S. PATENT DOCUMENTS 3,334,610 A * 8/1967 Faust ..... 118/32
4,364,142 A 12/1982 Pangle ..... 15/117
4,450,037 A 5/1984 Gavronsky ..... 156/441.5
4,776,152 A 10/1988 Kruk ..... 53/492
4,971,686 A * 11/1990 O'Dea et al. ..... 209/548
5,021,279 A * 6/1991 Whitener ..... 428/100
5,138,816 A * 8/1992 Holbrook et al. ..... 53/381.7
5,665,198 A 9/1997 Bieber et al. ..... 156/578
5,752,530 A * 5/1998 Traintinger ..... 132/201
5,800,540 A * 9/1998 Chin ..... 128/898
5,922,591 A * 7/1999 Anderson et al. ..... 435/287.2
6,273,602 B1 * 8/2001 Steiner et al. ..... 366/129
6,406,591 B1 * 6/2002 Beckstrom et al. ..... 156/441.5
6,554,956 B1 * 4/2003 Dolan et al. ..... 156/441.5
6,675,425 B1 * 1/2004 Iimura ..... 15/105

FOREIGN PATENT DOCUMENTS

EP 0376506 7/1990
JP 5-32231 * 9/1993

* cited by examiner

*Primary Examiner*—Mark A Osele
(74) *Attorney, Agent, or Firm*—Sughrue Mion, PLLC

(57) ABSTRACT

This invention relates to a separator for separating envelope flaps from envelope bodies, of which the active separation zone is formed by a supple part which comprises a peripheral edge arranged at the level of an envelope conveyor deck.

8 Claims, 3 Drawing Sheets

SEPARATOR DEVICE FOR FRANKING MACHINE FEEDER

BACKGROUND OF THE INVENTION

1. Field of the Invention

The present invention relates exclusively to the domain of mail handling and more particularly to a separator integrated in a mail item feed module of a franking machine.

2. Brief Description of Related Developments

Applicants' French Patent Application No. 0116680 discloses an envelope flap moistening device intended to be integrated in a mail item feed module of a franking machine and comprising a separator for separating the flap of the envelope from the body of the envelope and suction means disposed just before the separator in order, in cooperation with a presser finger, to apply the envelope in the direction of these suction means and to detach the flap from the body of the envelope and thus facilitate passage thereof under the separator.

This device gives overall satisfaction for all types of envelopes. However, after a very large number of passages of envelopes, a certain relaxing occurs in the pressure exerted by the presser finger which, particularly when the closed envelope is imperfectly sealed with a slightly deformed flap, may cause jamming at the level of the separator, which is a source of deterioration of this flap if the operator does not then effect an adequate adjustment.

It is therefore an object of the present invention to provide a separator for moistening device which overcomes this residual drawback, requiring no adjustment by the operator. Another object of the invention is to produce this separator simply and inexpensively, which separator can be integrated in a conventional high-rate processing feeder structure without difficulty.

SUMMARY OF THE INVENTION

These objects are attained by a separator for separating envelope flaps from envelope bodies, of which the active zone of separation is formed by a supple part which comprises a peripheral edge advantageously arranged at the level of an envelope conveying deck.

With this particular configuration of the separator, the closed envelopes whose flaps are imperfectly sealed are thus processed without jamming or tearing and without the intervention of an operator, and the envelopes to be closed (with folded-down flaps or nested), whose flaps are separated from the body of the envelope, always remain perfectly guided beneath the separator.

According to the form of embodiment envisaged, the supple part may be made by plastic overmoulding on a small-diameter steel wire or by moulding an elastomer of silicone type.

This supple part is preferably detachable from a rigid part of the separator. It may be connected to said rigid part by a fixation means, of slideway or rail type for example, or simply articulated on said rigid part by a hinge. The fixation means is advantageously made of plastics material.

The invention also relates to a moistening device integrating such an improved separator and to a mail item feed module of a franking machine provided with such a moistening device.

BRIEF DESCRIPTION OF THE DRAWINGS

The invention will be more readily understood on reading the following description given by way of non-limiting example, with reference to the accompanying drawings, in which.

DETAILED DESCRIPTION OF THE PREFERRED EMBODIMENT(s)

Figure 1:
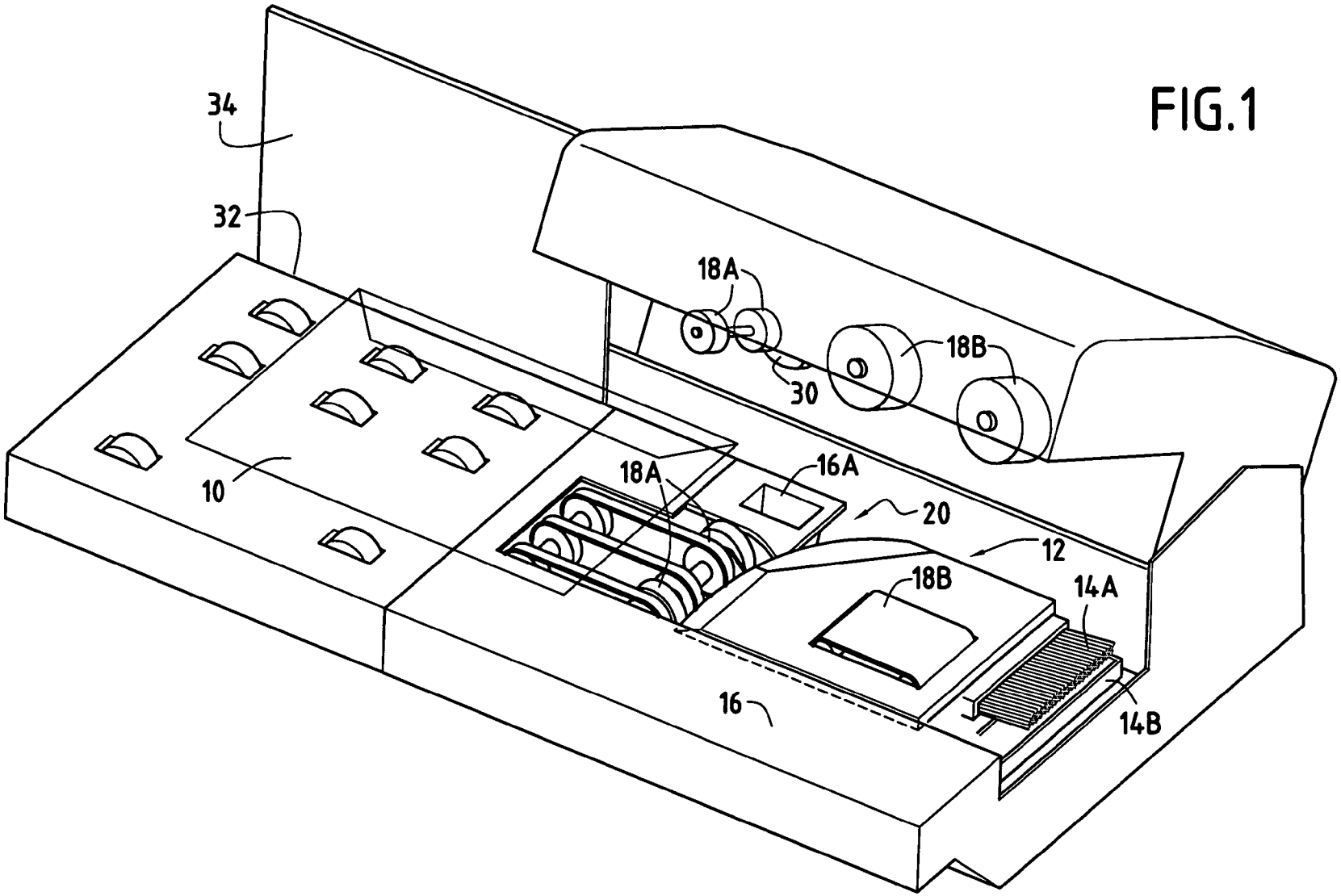
FIG. 1 is a view in perspective of a feeder comprising a separator according to the invention.
Figure 2A:
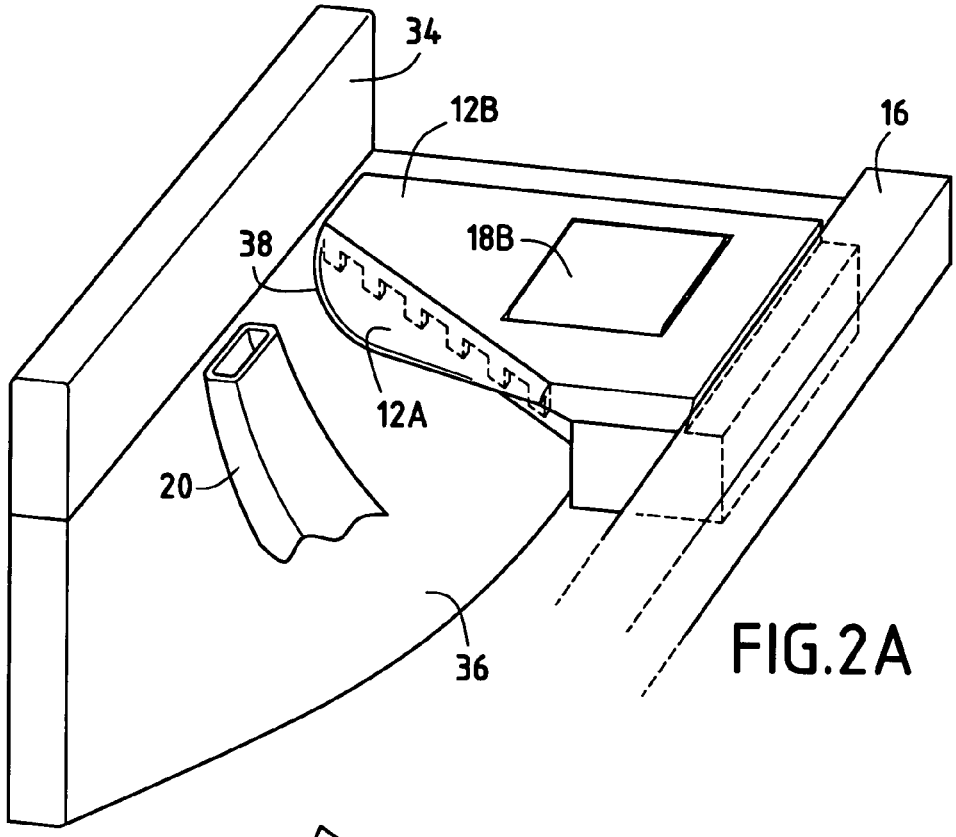
FIGS. 2A and 2B are two views in front perspective of the feeder of FIG. 1, the moistening device and conveyor deck having been omitted.
Figure 2B:
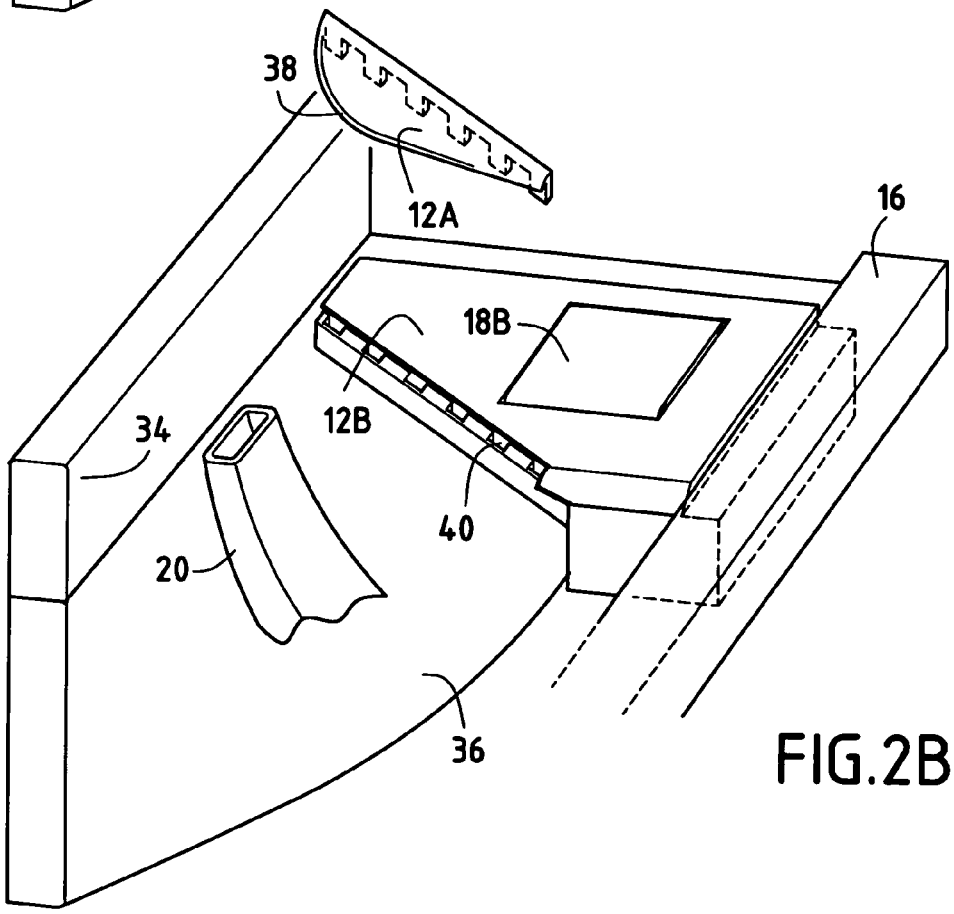

Referring now to the drawings, FIGS. 1, 2A and 2B schematically show in perspective, in side and front view, a mail item feed module intended to be disposed at the entrance of a franking machine. Such a module may, of course, equally well be integrated directly in this machine.

The mail items 10 that can be processed by this module are preferably envelopes with flaps which are open (also called nested), folded down or closed. However, it may also be question of simple documents (for example of A4 format) on which postal indicia will then be directly printed.

The feed module comprises, in addition to its conventional document reception and selection parts (not shown), a moistening device formed successively (i.e. from upstream to downstream with respect to the direction of advance of the mail items) by a separator 12 for separating the envelope flap 10A from the envelope body 10B, and a moistener 14, placed just behind this separator, for moistening this flap once the flap 10A is separated from the envelope body 10B. This moistener is for example formed by a brush 14A whose end rests on the surface of a water reservoir 14B arranged under a deck 16 conveying the mail items through the feed module, a flap in that case being moistened upon its passage between the brush and the reservoir. Drive means 18A, 18B are conventionally disposed both at the entrance of the separator to convey the mail items beyond the separator up to the moistener and at the level or outlet of the separator to convey them up to the entrance of the franking machine or of the following module of the mail handling machine, in principle a module for printing postal indicia (not shown), when the feed module is integrated in this machine. In general, the inlet rollers of the printing module act as means for closing the previously moistened envelopes, unless the feed module presents its own closure means.

The moistening device also comprises suction means, arranged beneath the conveyor deck 16 and whose suction mouth 16A opens out on the passage of the envelope flaps, just in front of the separator and downstream of the conveyor rollers 18A, to allow a particularly easy detachment of these flaps with respect to the envelope bodies, particularly in the case of thick envelopes. Finally, in order to facilitate a clear-cut closure of the flaps for the closed envelopes and a clear-cut opening of the flaps for the envelopes with folded-down flaps, this moistening device further comprises a presser 30 articulated on the frame of the feeder against elastic means (not shown) and intended to compress the flaps of the envelopes in the direction of the opening 16A of the suction conduit during passage thereof over this conduit.

For processing nested envelopes, the feeder is advantageously provided with a groove 32 made in the conveyor deck 16, all along a registration wall 34 of this feeder. This wall 34 for aligning the mail items further comprises, beneath the conveyor deck, a fixed deflector 36 profiled in the form of a delta wing to guide and progressively fold down the flap of these envelopes from their initial position at 90° to a terminal position close to 30° allowing their passage beneath the separator and their moistening under optimum conditions (cf. FIGS. 2A and 2B).

According to the invention, the separator 12 comprises, in its active separation zone, a supple part 12A, which is advantageously detachable, whose peripheral edge 38 is disposed at the level of the conveyor deck 16. This supple part is preferably made by plastic overmoulding on a steel wire of small diameter (of the order of a millimeter). Of course, moulding of an elastomer of silicone type can also be envisaged. Its articulation on the rigid part 12B of the separator may be effected by means of a slideway 40 or any other like element such as a rail or more simply a hinge. This means of fixation between the supple (12A) and rigid (12B) parts of the separator is advantageously made of plastics material.

Figure 3:
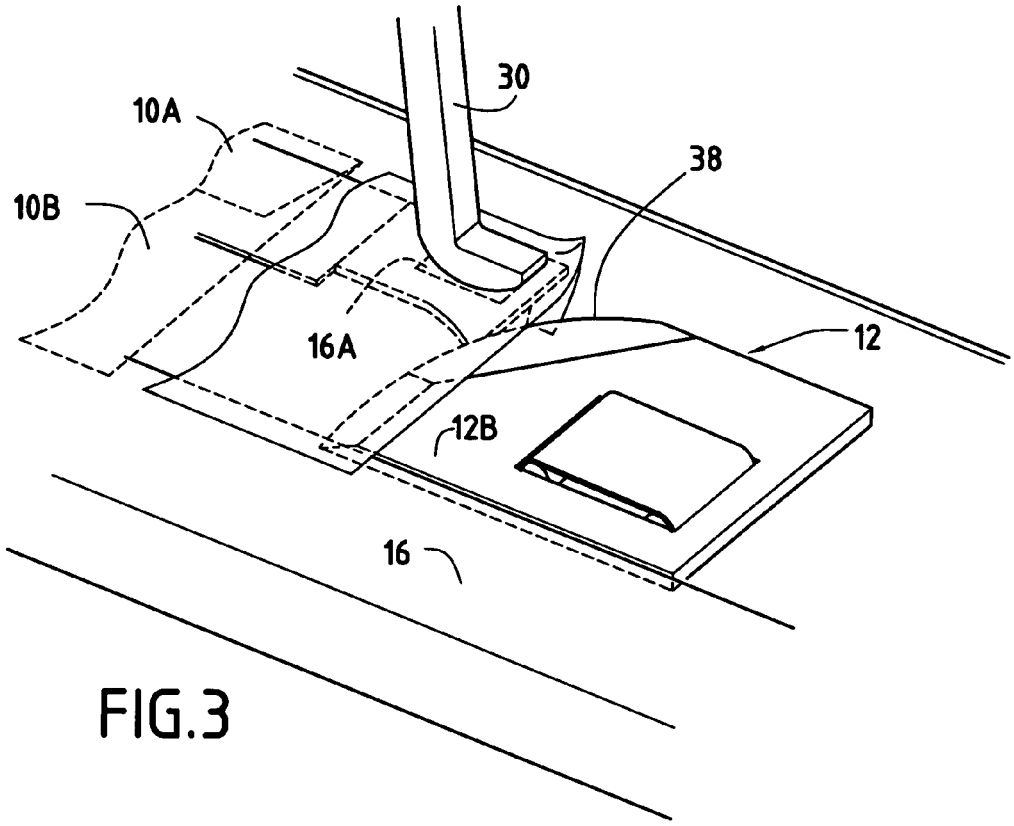
FIG. 3 is a schematic view illustrating the principle of opening of an envelope with flap folded down with the separator of FIG. 1.
Figure 4:
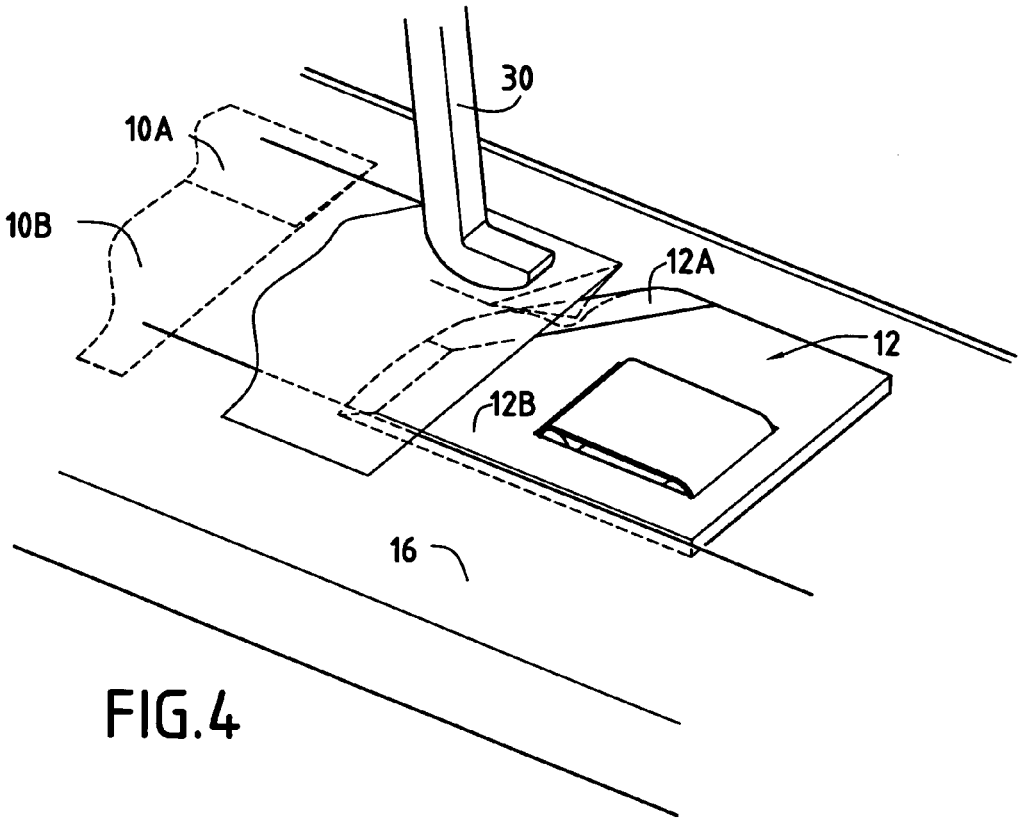
FIG. 4 is a schematic view illustrating the principle of processing of a closed envelope with the separator of FIG. 1.

Functioning of the separator according to the invention will now be explained with reference to FIGS. 3 and 4. In particular, the passage of envelopes with folded down flaps is firstly illustrated in FIG. 3. In this position, these envelopes which initially rest on the drive rollers 18A, are directed towards the separator 12 which performs it normal function of separation between the body 10B and the flap 10A of the envelope, the body passing above the separator and the flap 10A, applied in the direction of the inclined surface 28, passing below in order thus to allow its subsequent moistening. This conventional function of separation is also present with the passage of nested envelopes, since the envelope flap 10A, located beneath the deck in the groove 32, is guided beneath the separator 12 then folded towards the moistener 14A, 14B by the fixed deflector 38, while the envelope body 10B, which now rests alone on the conveyor deck 16, passes directly above the separator and the moistener.

On the contrary, the separator of the invention brings a considerable improvement in the processing of closed envelopes. Such envelopes which may present an imperfectly sealed zone 10C which is a source, in the prior art, of undesirable contacts with the separator, no longer raise problems with the improved separator configuration of the invention. As shown in FIG. 4, by the suppleness of the active part of the separator, the envelope flap 10A has a possibility of escaping which did not exist with a rigid structure allowing this flap no freedom. In effect, the front of a poorly closed envelope may be introduced beneath the separator in the same way as an open envelope. However, while a rigid separation edge (having the effect of a cutting blade) would tear the flap of a poorly closed envelope, a supple edge, on the contrary, on deforming under the action of the passage of this half-open flap, induces an excess thickness of the active part of the separator which then makes it possible for the flap, which may fold without tearing, to escape. The poorly closed envelope with half-open flap will therefore pass above the separator and therefore the moistener without tearing.

With the structure of the invention, it is therefore possible to process equally well envelopes which are sealed and non-sealed, whether they be with folded down flaps or nested flaps. In particular, the separator makes it possible, without any adjustment, to avoid a jamming of the envelopes with poorly closed flaps. Similarly, there is nothing to oppose passage of simple documents, of format A4 in particular. In addition, the simplicity of the means carried out allows them to be integrated in a conventional feeder or franking machine is structure without any structural modification. It simply suffices to replace the existing separator by the separator of the invention, having the same dimensions and shape except for its active part which is rendered supple.

What is claimed is:

1. A mail item feed module of a franking machine comprising a separator for separating folded envelope flaps from envelope bodies, of which an active zone of separation comprises a supple part, where the supple part deforms causing the separator to allow an improperly closed flap to pass by the separator.

2. The mail item feed module of claim 1, wherein said supple part comprises a peripheral edge arranged at the level of an envelope conveyor deck.

3. The mail item feed module of claim 1, wherein the supple part comprises overmolded plastic on a steel wire having a diameter of about one millimeter.

4. The mail item feed module of claim 1, wherein the supple part comprises a molded elastomer of silicone type.

5. The mail item feed module of claim 1, wherein said supple part is detachable from a rigid part of the separator.

6. The mail item feed module of claim 5, wherein the supple part is connected to the rigid part by a slideway or rail fixation means.

7. The mail item feed module of claim 6, wherein the fixation means comprises a plastic material.

8. The mail item feed module of claim 5, wherein said supple part is articulated on said rigid part by a hinge.

* * * * *